United States Patent [19]

Terry

[11] 4,092,052

[45] May 30, 1978

[54] CONVERTING UNDERGROUND COAL FIRES INTO COMMERCIAL PRODUCTS

[75] Inventor: Ruel Carlton Terry, Denver, Colo.

[73] Assignee: In Situ Technology, Inc., Denver, Colo.

[21] Appl. No.: 788,542

[22] Filed: Apr. 18, 1977

[51] Int. Cl.[2] ..... E21C 43/00

[52] U.S. Cl. ..... 299/2; 166/261

[58] Field of Search ..... 166/251, 256–262; 299/2, 4; 175/12; 169/64

[56] References Cited

U.S. PATENT DOCUMENTS

| | | | |
|---|---|---|---|
| 2,497,868 | 2/1950 | Dalin | 166/256 |
| 2,593,477 | 4/1952 | Newman et al. | 299/4 X |
| 2,896,931 | 7/1959 | Marquis | 299/4 |
| 3,421,587 | 1/1969 | Heavilon et al. | 169/64 X |
| 3,865,186 | 2/1975 | Von Hippel | 299/2 |
| 3,924,680 | 12/1975 | Terry | 166/258 |
| 3,927,719 | 12/1975 | Maser | 169/64 X |

*Primary Examiner*—Ernest R. Purser

[57] ABSTRACT

An underground coal fire is smothered by sealing the overburden for a minimum depth over the coal deposit. Wells are drilled into the fire area and the underground reaction zone is pressurized. Using various combinations of injecting oxidizers and reducing agents the coal deposit is produced in situ to yield a variety of useful products. Wells are cased without cement and with the hermetic seal attained by a column of slurry between the casing and well bore.

15 Claims, 2 Drawing Figures

CONVERTING UNDERGROUND COAL FIRES INTO COMMERCIAL PRODUCTS

BACKGROUND OF THE INVENTION

There are numerous coal deposits in the United States that are afire, many of which have been burning for 10 years or more. Some underground coal fires are burning in coal deposits that never have been mined, the fire having started at an outcrop of the coal. Other underground coal fires are burning the residual coal in abandoned mines. In both cases potentially valuable natural resources are being consumed for no useful purpose. Noxious gases are generated without control from such fires, resulting in a hazardous environment in the vicinity of each fire. Further, the fires consume large quantities of coal and thus create void space underground which in time will result in subsidence of the overburden. Such subsidence often opens cracks from the surface of the ground into the underground coal. These cracks can serve as conduits to supply fresh air to the fire or to serve as chimneys to remove the products of combustion from the fire.

In the presence of an oxidizer such as air, coal will burst into flames when its temperature reaches the ignition point of approximately 800° F. The sequence of events leading to fire need not begin, however, with a temperature nearly so high. Once coal warms to a temperature near that of the boiling point of water (212° F), if a supply of air is present, the sequence will continue to ignition by so-called spontaneous combustion when the heat of oxidation builds up more rapidly than it dissipates. Other unplanned ignition of a coal deposit can occur as a result of grass or brush fires, warming fires kindled by persons outdoors on a cold day, lightning striking the earth and the like.

When an underground coal deposit is ignited it will burn to resource exhaustion if oxygen remains available. In many cases the fire may propagate undetected for weeks or months and in some cases years. The longer a fire proceeds the more difficult its eventual control is apt to be. The unplanned fire underground propagates with the same combustion chemistry as the planned and controlled fire above ground. With an abundant supply of oxygen, carbon in the coal burns to carbon dioxide, hydrogen burns to water vapor and sulfur burns to sulfur dioxide. Most unplanned fires underground, however, propagate with less than an abundant supply of oxygen resulting in much of the carbon converting into carbon monoxide, some of the hydrogen combining with sulfur to form hydrogen sulfide and some of the hydrogen combining with oxygen to form water vapor. With carbon monoxide and hydrogen sulfide emanating from the underground fire, the hazards to people and animals nearby is significantly increased.

When the unplanned underground fire has been underway for a considerable period of time, substantial portions of the underground area have been subjected to high oxidation temperatures in the order of 2,000° F and the carbon in the coal is incandescent. In underground areas where there is room for flames, temperatures in the order of 3,000° F are not uncommon. Attempts to douse the fire with water are generally unrewarding because the water reacts with incandescent coal to form hydrogen and carbon monoxide, both of which are potent fuels that may serve to intensify the fire.

One simple way of stopping the fire is to cut off the oxygen supply, for example by piling dirt over each conduit to the fire. Such a procedure will stop the oxidation underground, but does little to dissipate the heat in the former burn area underground. The former burn area underground will remain at a temperature above the ignition temperature of coal for long periods of time, in some cases a decade or more. Should the underground hotspot gain a new source of oxygen, such as rain washing away the dirt cover or new cracks forming from subsidence, the fire will rekindle.

Other methods of stopping the fire include grubbing out the fire area in its entirety, grubbing out the coal ahead of the fire front and allowing the fire to burn itself out, flushing the fire area with an inert material such as fly ash, and the like. All such methods involve costs without offsetting revenues. Most methods require the test of time to assure that the method has been successful.

All methods of controlling underground coal fires require a certain amount of disruption of normal activities conducted at the surface of the ground. If the fire is located in a populated area, some of the population may be required to relocate either temporarily or permanently. Such disruption adds to the costs of controlling the fire. A considerable improvement over present methods can be attained by converting the products of combustion to commercial products, thereby eliminating the hazards of migrant noxious gases and generating revenues to offset costs. It is an objective of the instant invention to teach such methods.

SUMMARY OF THE INVENTION

As in the methods of the prior art, the methods of the instant invention begin with a survey of the extent of the underground fire, together with a survey of its likely extent if allowed to proceed unchecked. Limits of the project area can then be established taking into account the costs of disruption of normal surface activities, the amount of coal available for conversion into commercial products, the costs of such conversion and the expected revenues to be derived.

The unplanned underground fire has been propagating at a pressure near that of atmospheric, the fire has been sustained by intake of air into the fire zone and expulsion of the products of combustion into the atmosphere. Generally, modifications to this natural sequence of events are required for control purposes. In many cases all sources of air intake are not apparent by simple observation. Conversely, some conduits used to expel the products of combustion also may not be apparent at pressures near atmospheric pressure. Further, the natural conducts for intake and expulsion are generally unsuitable for efficient conversion of the products of combustion into commercial products.

It is preferred that the underground coal deposit be subjected to a gas pressure exceeding normal atmospheric pressure, therefore all known conduits to the underground fire are closed. It is desirable that the overburden above the coal be as uniform in thickness as is practical. Preferably the minimum thickness of the overburden should be in the order of 100 feet. Within the project area, overburden thicker than the desired minimum can be removed and relocated in areas where the overburden is thinner than the desired minimum. Preferably such relocated overburden is compacted to approximate the density of the natural overburden. In this manner many, if not all, of the original natural conduits to the fire will be sealed.

A series of production wells is then drilled into the coal formation and the mine is brought up to planned operating pressure, for example 50 psig, by injecting oxidizer in a portion of the wells and holding back pressure on the remainder of the wells. Should the mine pressure stabilize at the planned level with injected gas volumes substantially balancing with gas withdrawal volumes, the mine is properly sealed for the methods of the instant invention. Most likely, however, the mine pressure will not stabilize at the desired level and remedial action will be required to close off unplanned conduits to the reaction zone in the underground coal. Due to the higher pressure underground these unplanned conduits are generally easy to locate, although the exact orientation of each conduit may not be apparent. The unplanned conduits oriented in a generally vertical direction can be sealed by injecting a mud slurry into the conduit until sufficient hydrostatic head pressure is established to offset mine pressure.

For unplanned conduits oriented in a generally horizontal direction, a series of vertical wells is drilled into the overburden in an alignment generally perpendicular to a line from the surface vent to the fire zone underground. Mud slurry is injected into these wells to mud off the active conduit and the adjacent permeable areas of the overburden, and preferably a hydraulic head is maintained on the mudded off conduits.

The aforementioned production wells are drilled generally in a vertical direction from the surface of the earth through the overburden and into the fire zone. Such wells are drilled preferably in three phases. In the first phase the bore hole, for example 16 inches in diameter, is sunk to a convenient depth, for example 25 feet. A protective pipe, for example 13⅝ inches in diameter is set in the hole, and cemented into place. In the second phase the borehole, for example 11 inches in diameter, is deepened to a competent formation in the overburden, for example to a point 10 feet above the fire zone. A string of casing is then placed from a point, for example 4 feet above the top of the protective pipe to the bottom of the hole. Centralizers commonly used in the petroleum industry may be employed to position the casing so that its center line substantially coincides with the centerline of the borehole. Departing from standard practice in setting casing, the casing is not cemented in place. Instead a mud slurry is injected into the annulus between the casing and the wall of the borehole. In the third phase the borehole, for example 5 inches in diameter is deepened into the fire zone or coal.

Suitable wellhead fixtures are installed on the upper end of the casing to permit injection and withdrawals of fluids through the casing. The hermetic seal between the atmosphere is accomplished by the wellhead fixtures together with the column of mud slurry located in the annulus between the casing and the well bore. The mud slurry in its elementary form is composed of water and approximately 40% solids such as native clay. With the casing supported by a ledge of underground rock, the seal between the column of slurry and the uncased borehole below the casing will not be completely water tight. Water will slowly leak from the column of slurry and trickle through the uncased borehole and into the fire. Make-up slurry, for example water and 20% solids, is added as necessary to maintain the column of slurry at a height sufficient to offset planned mine pressure, for example 50 psig.

In this mode the casing in each production well is relatively free to elongate or contract with changing temperature. Each production well is equipped so that it may be used as an injector for fluids or as a withdrawal well for the recovery of generated fluids. When a production well is employed as a withdrawal well the hot exit gases will transfer heat through the casing to the slurry, converting the carrier liquid to vapor and tending to bake the solids into a fused mass. In the early stages of production it is desirable to alternate the use of the production well from producer to injector, for example operating a well as a withdrawal well for a five minute time period, then operating the same well as an injection well for a similar time period. In this manner the temperature of casing can be limited to desired levels.

While only two wells are required for most of the methods of the instant invention, a commercial project would require a multiplicity of wells. Looking first at the two well system, preferably each well is equipped to perform a dual role, which is to say that one well serves as an injector well and the other as a withdrawal well with the capability of reversing roles. The system then is capable of continuing reactions of the underground coal in either a predominently oxidizing environment or in a predominently reducing environment. Further capabilities include the ability to operate in an oxidizing environment through a portion of the underground circuit and in a reducing environment through the balance of the underground circuit. Still further capabilities include the ability to operate in a reducing environment through a portion of the underground circuit and a pyrolyzing environment through the balance of the underground circuit.

With the underground coal fire hermetically sealed from the atmosphere and two communication passages established between surface facilities and the underground fire, remaining coal can be converted to commercial products under controlled conditions. In the most elementary form copious quantities of air may be injected with hot gases withdrawn. These hot gases would be commercially useful primarily for the sensible heat they contain, but also may have further commercial use as reducing agents when reinjected through the underground circuit. For example in the first pass through the circuit using an air blast the withdrawn gases (nitrogen, carbon dioxide and sulfur dioxide) would be stripped of a portion of their sensible heat and then be reinjected through the circuit for a second pass. In the second pass the nitrogen would generally not enter into a reaction but in the absence of available oxygen the carbon dioxide would react with hot carbon to form carbon monoxide and the sulfur dioxide would react with hydrogen in the hot coal to form hydrogen sulfide. Carbon monoxide and hydrogen sulfide both are products of commercial significance. A third pass can be made by injecting water which reacts with the hot coal to form hydrogen and carbon monoxide, with the sulfur content of the coal primarily reacting to form hydrogen sulfide, all useful products of commercial significance.

By increasing the system to three wells further capabilities are added to the system. For example by injecting water in the first well and using the third well as a withdrawal well, the products created in the circuit as previously pointed out principally are hydrogen and carbon monoxide. With the second well located in the circuit between the first and third well an additional reaction can be attained by injecting steam in the second well. The principal products attained in this arrangement are extra hydrogen and carbon dioxide, thus causing a greater than one to one ratio between hydrogen and carbon monoxide in the withdrawal gases. When the ratio is thus adjusted to two parts of hydrogen to one part of carbon monoxide and the carbon dioxide is separated in surface facilities, the result is synthesis gas feedstock for the manufacture of methanol. Similarly when the hydrogen to carbon monoxide ratio is adjusted to three to one the resulting feedstock can be converted to methane.

Further capabilities can be attained by locating one of the wells in the coal outside the fire zone. By injecting an oxidizer such as air into this well, the fire can be drawn to the well in a reverse burn that will create a channel from the main fire zone to the well. Upon terminating oxidizer injection and converting the well to a withdrawal well to work in concert with an injection well in the fire zone, the coal surrounding the channel can be subjected to pyrolysis. Gases released by pyrolysis are generally both condensible and noncondensible, with the condensible gases being rich in mixed coal chemicals and the noncondensible gases being a fuel gas with a heat content in the order of 500 BTU per standard cubic foot.

Thus it may be seen that a variety of commercial products may be derived from a properly sealed underground coal fire. The coal in the project area can be consumed to resource exhaustion and the void space underground will be substantially eliminated by subsidence of the overburden. Thus the overburden will become stabilized and upon completion of the project the surface area can be reclaimed for permanent productive use.

DESCRIPTION OF THE PREFERRED EMBODIMENT

The process begins by closing off the natural conduits to the underground coal fire as described in the foregoing and as further described in my copending patent application Ser. No. 774,597 filed Mar. 7, 1977.

Figure 1:
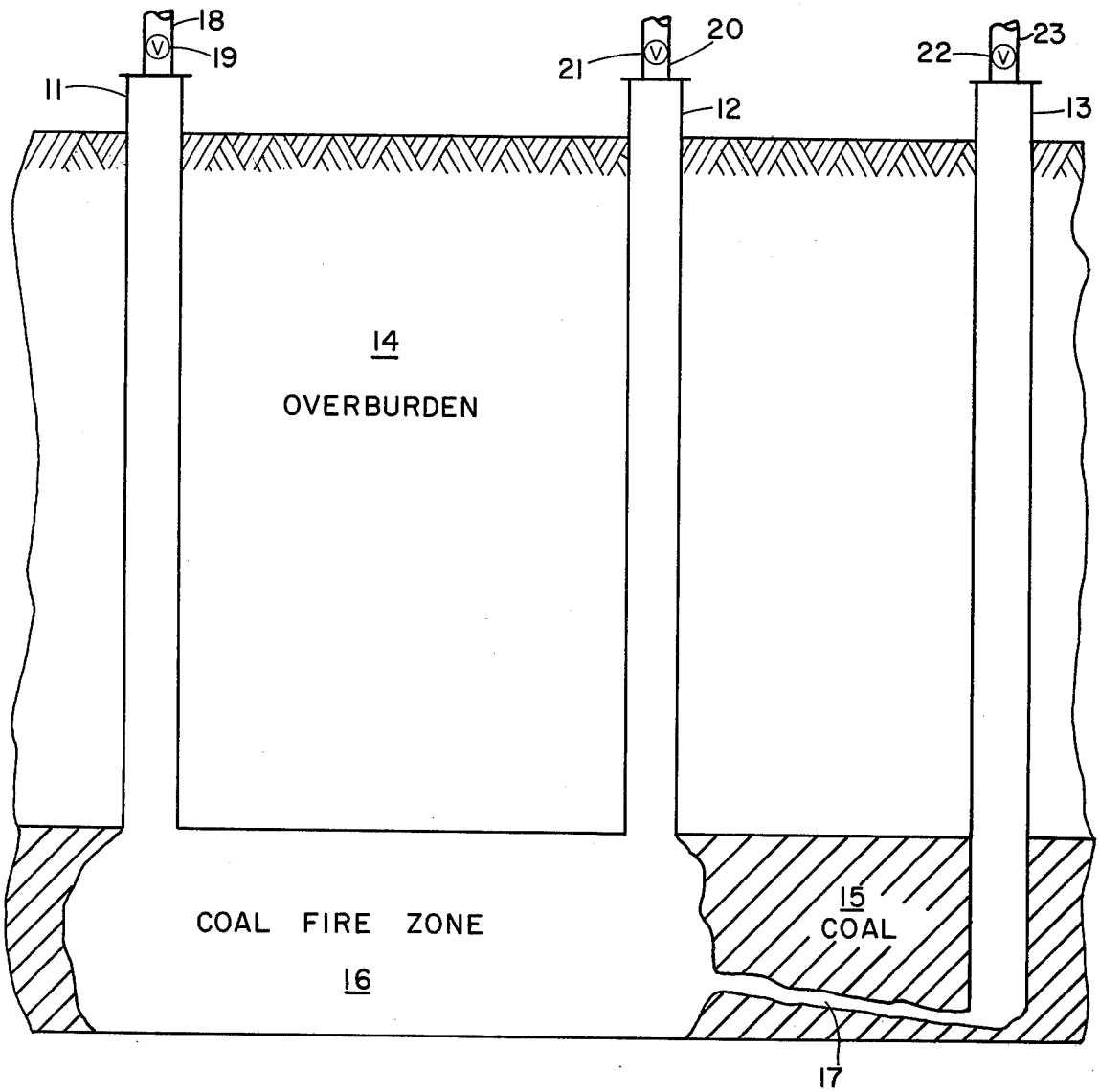
FIG. 1 is a diagrammatic vertical section showing an underground coal fire and the arrangement of apparatus for the methods of the invention.

Referring to FIG. 1, two wells 11 and 12 are drilled from the surface of the earth into the underground coal fire. Each well is hermetically sealed and contains a well head that is equipped with a flow line. Flow line 18 contains valve 19 so that the flow line may be engaged in the process or shut off from the fluid flows. Flow line 20 contains valve 24. A third well 13 is drilled from the surface of the earth into the coal deposit adjacent to the coal fire zone. Well 13 also is hermetically sealed and is equipped with a wellhead containing flow line 23 which contains valve 22.

With all wells shut in and the coal fire zone bereft of oxygen, reactions with the coal are substantially terminated. The coal fire zone 16, sometimes called the reaction zone, is at relatively low gas pressure, for example in the order of 15 psig. The underground processes may resume by injecting oxidizer, for example compressed air, through well 13 via flow line 23. Such injection continues with wells 11 and 12 remaining shut in until the pressure in reaction zone 16 reaches the desired level, for example 50 psig. Initially the oxidizer injected into well 13 will disseminate in the coal deposit in numerous directions away from the wellbore, with a portion of the oxidizer migrating through the permeability in the coal into reaction zone 16. That portion of the oxidizer reaching reaction zone 16 will rekindle the fire and the fire will burn slowly toward the oncoming oxygen until a channel 17 is burned connecting fire zone 16 with well 13. Prior to burn through, the injection pressure in well 13 must be relatively high, for example approximately 1 pound of pressure for each foot of overburden depth to the coal. Once channel 17 reaches well 13 the injection pressure will show a dramatic drop, signaling that burn through has occurred. Prior to burn through the fire has been proceeding as a reverse burn. After burn through the fire will propagate in channel 17 as a forward burn away from well 13. Or the fire may be terminated by discontinuing injection of oxidizer.

With the apparatus arranged as shown in FIG. 1, numerous in situ techniques may be employed. The following examples are given by way of illustration, although those skilled in the art will be able to envision others. The first process could begin with valves 21 and 22 closed and with compressed air, for example at 75 psig, injected into well 11. Valve 21 should be opened to the extent necessary to maintain sufficient back pressure to yield the desired mine pressure, for example 50 psig, in reaction zone 16. With a copious supply of injected air the return gases through well 12 would be nitrogen, carbon dioxide and sulfur dioxide. These gases would be useful for the sensible heat they contain and the pair of carbon dioxide and sulfur dioxide would have further use as described hereinafter.

A second procedure could be injection of compressed air into well 11, shutting in well 12 and opening valve 22 to the extent necessary to maintain desired mine pressure. Near the bottom of well 11 the gases of the reaction would be as described in the said first process above, but as the gases proceed through reaction zone 16 less and less oxygen is available for reaction and the reaction environment changes from predominently oxidizing to predominately reducing. At this point the migrating gases are substantially all nitrogen, carbon monoxide and hydrogen sulfide. These hot gases entering channel 17 will cause pyrolysis of the coal exposed in channel 17. The gases released by pyrolysis will enrich the migrating gases which are then captured at the surface. In addition to the useful gases carbon monoxide and hydrogen sulfide, the gases captured at the surface also include condensible and noncondensible gases of pyrolysis, the condensible gases being composed of mixed coal chemicals and the noncondensible gases having a calorific content in the so-called mid BTU range, for example in the order of 500 BTU per standard cubic foot.

Well 13 as illustrated in FIG. 1 is an outpost well that is useful in collecting products of the underground reactions, particularly when it is desirable to add the products of pyrolysis to the gas stream. Well 13 also is useful in controlling the direction of propagation of the underground fire. Movement of the fire toward well 13 can be accelerated by injecting oxidizer into well 13 and removing the products of the reactions through another well, for example well 11. In time channel 17 will be substantially enlarged and may be no longer suitable for the pyrolysis reaction. At this point another outpost well would be drilled apart from well 13 in the direction planned for fire propagation.

After channel 17 has been significantly enlarged, a third procedure may be undertaken. With valves 21 and 22 closed air is injected into well 11 with valve 22 opened to the extent necessary to maintain desired mine pressure. Air injection is continued, sometimes called an air blow, until the coal in the blast pattern is incandescent, for example a blow of six minutes. Air injection is terminated and followed immediately by steam injection into well 11. Steam reacts with the incandescent carbon to form equal parts of carbon monoxide and hydrogen, both gases of commercial significance. The steam injection, sometimes called the steam run, is continued until the coal is cooled below incandescent temperature, for example a run of 10 minutes. Initially the gases collected at the surface will be a mixture of the gases of the air blow and steam run, but within a short time, for example approximately one minute, the air blow gases will be purged from the underground circuit and the gases arriving at the surface will be substantially all carbon dioxide and hydrogen. These gases are particularly useful in manufacture of a host of commercial products in surface facilities. These gases are even more useful when the ratio of hydrogen to carbon monoxide is adjusted, for examples two parts hydrogen to one part carbon monoxide for the manufacture of methanol and three parts hydrogen to one part carbon monoxide for the manufacture of methane.

In a fourth procedure the ratio of hydrogen to carbon monoxide can be adjusted in situ. The procedure begins by injecting air into well 11 and withdrawing the products of the reaction through well 13. When the coal becomes incandescent the air injection is terminated followed immediately by a steam run. The steam injection is continued through well 11 until the underground circuit is purged of the gases generated in the air blow. At this time the gases of the underground reaction will be substantially hydrogen and carbon monoxide in equal parts. For the balance of the steam run, steam also is injected into the reaction zone through well 12, establishing the so-called water shift reaction. In the water shift reaction steam reacts with the hot carbon monoxide to yield hydrogen and carbon dioxide. With the hydrogen already in the underground gas stream plus the hydrogen generated by the water shift reaction plus the oxidation of a portion of the carbon monoxide to carbon dioxide, the ratio of the accumulated hydrogen to that of the residual carbon monoxide can be adjusted significantly from the original ratio of one to one. The carbon dioxide can be removed from the gas stream at the surface by one of several commercial methods and the residual mixture of hydrogen and carbon monoxide is then a true synthesis gas.

A fifth procedure can be practiced by closing valves 21 and 22 and injecting air into well 11, then opening valve 21 to the extent necessary to maintain desired mine pressure. The products of the reaction are captured and saved at the surface. The air blow continues until the coal becomes incandescent, the air injection is terminated followed immediately by the injection of the said products of the reaction that had been saved at the surface. Such reinjection in the absence of oxygen creates a reducing environment in the reaction zone and causes the reinjected carbon dioxide to reduce to carbon monoxide and sulfur dioxide to reduce to hydrogen sulfide. Thus some of the effuents that might otherwise be wasted to the atmosphere in the form of pollutents can be recycled and converted into products of commercial interest.

With the consumption of substantial amounts of coal underground a significant amount of void space will be created without the benefit of remnant pillars to support the roof. Therefore subsidence to the surface may be expected. Such subsidence results in significant ground shifts that can destroy well casing that is cemented in place. To minimize the damage to wells yet maintain a hermetic seal between the coal and the surface of the ground, special procedures are required for well completions.

Figure 2:
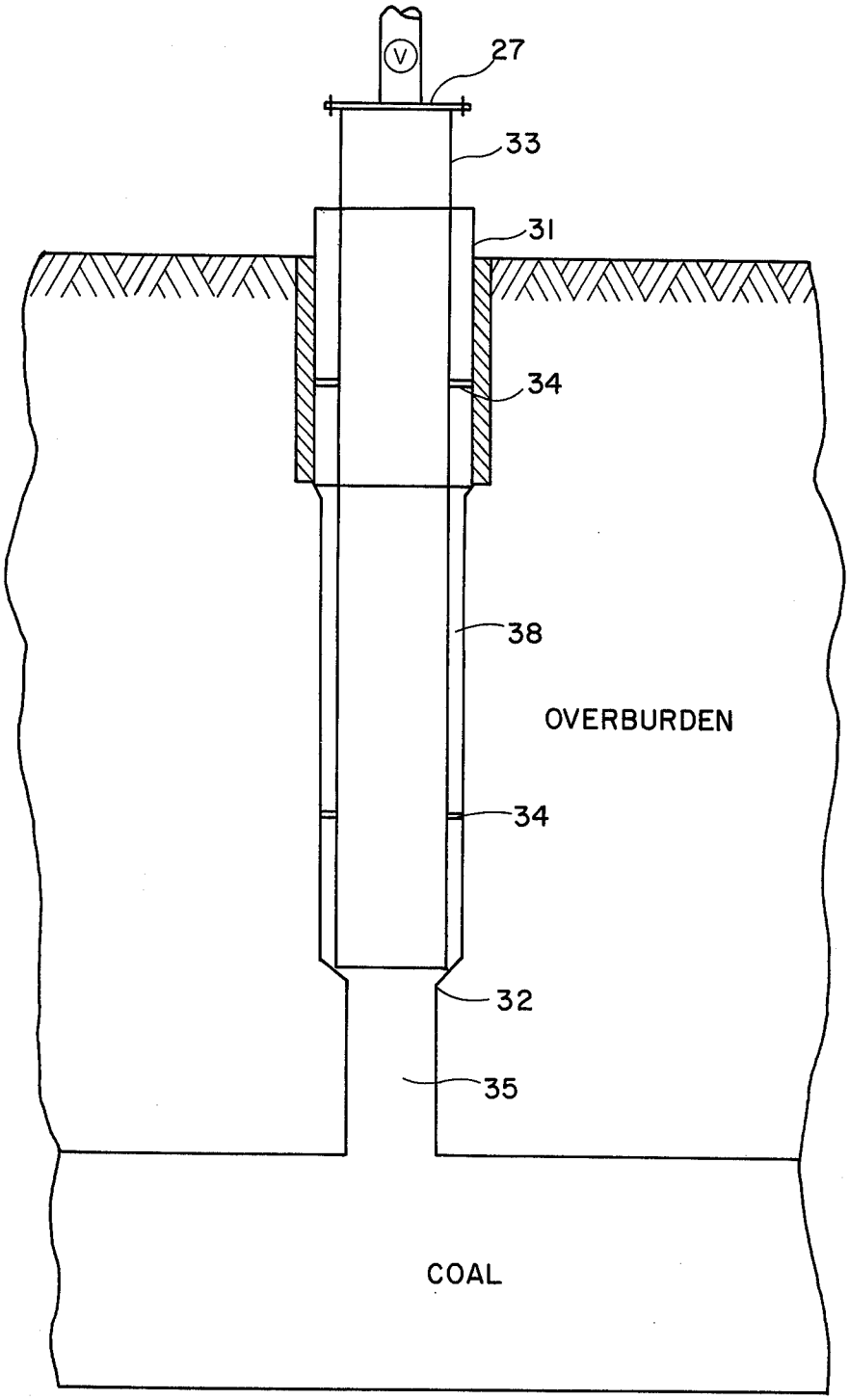
FIG. 2 is a diagrammatic vertical section of a well used in the methods of the invention.

Referring now to FIG. 2, it is preferred that each well be completed in three phases. In the first phase the well bore is drilled to a convenient depth, for example 25 feet deep and protective pipe 31 is set in the hole. Such protective pipe may be cemented in place or the annulus between the well bore and the protective pipe may be tamped with well cuttings to hold the pipe in position. In the second phase well is then deepened to point 32 in the overburden, a point that could be, for example, 10 feet above the coal seam. A casing 33 is set from the surface of the ground to the bottom of the hole. The casing is positioned in the center of the well bore using centralizers 34 commonly used in the petroleum industry, such centralizers containing openings to permit the flow of fluids into the annulus between the casing and the well bore. A slush mud slurry, for example water and 40% solids, is injected into the annulus 38 to provide a hermetic seal. The height of the column of slurry is maintained with due regard for the amount of gas pressure the seal must withstand. In the third phase, the well is deepened into the coal seam. A suitable wellhead 27 is affixed to the casing to complete the hermetic seal between the coal seam and the atmosphere.

With this arrangement the casing is relatively free to elongate and contract with changing temperature. Also the casing has a cushion of slurry to accomodate movement of the overburden without placing undue stress on the casing itself.

While the instant invention has been described with a certain degree of particularity it is recognized that changes in detail of structure may be made without departing from the spirit thereof.

What is claimed is:

1. A method of controlling an underground coal fire, comprising the steps of:

redistributing the overburden over the underground coal deposit with the resultant closing of conduits between the surface of the earth and the said underground coal deposit, establishing a first communication passage from the surface of the earth to the said underground, the said first communication passage being hermetically sealed, establishing a second communication passage from the surface of the earth to the said underground coal, the said second communication passage being spaced apart from the said first communication passage and the said second communication passage being hermetically sealed, injecting a reactant fluid into the said first communication passage and into the said underground coal, and withdrawing the products of reaction between the said reactant and the said underground coal through the said second communication passage.

2. The method of claim 1 wherein the said reactant fluid is an oxidizing agent.

3. The method of claim 1 wherein the said reactant fluid is a reducing agent.

4. The method of claim 1 wherein the said reactant fluid is a pyrolyzing agent.

5. The method of claim 1 wherein the said injecting a reactant fluid is comprised of two phases, the first of the said two phases being the injection of an oxidizing agent and the second of the two phases being the injection of a reducing agent.

6. The method of claim 5 further including the steps of purging the underground circuit of the products of reaction created by the said injection of the said oxidizing agent by displacing the said products of reaction created by the said injection of the said oxidizing agent with a first portion of the products of reaction created by the said injection of the said reducing agent, then capturing the remainder of the products of reaction created by the said injection of the said reducing agent apart from the said first portion of the products of reaction created by the said injection of the said reducing agent.

7. The method of claim 1 wherein the said first and second communication passages are boreholes from the surface of the earth through the overburden and into the underground coal, the said boreholes being completed in three steps, the first of the said three steps being the sinking of the borehole of a first diameter from the surface of the ground into the uppermost portion of the said overburden, then setting a protective pipe within the borehole of the said first of the said three steps; the second of the said three steps being the further sinking of the said borehole of a second diameter, the said second diameter being a lesser dimension than the said first diameter, the said borehole of the said second diameter being bottomed in the lowermost portion of the said overburden, then setting a casing from the surface of the earth through the said protective pipe to the bottom of the said borehole created by the said second of the said three steps; and the third of the said three steps being the further sinking of the said borehole of a third diameter, the said third diameter being a lesser dimension than the said second diameter, the said borehole of the said third diameter being bottomed in the said coal.

8. The method of claim 7 further including the step of establishing a hermetic seal between the said casing and the said overburden by establishing a column of fluid in the annulus between the said casing and the said overburden.

9. The method of claim 1 further including the steps of establishing a third communication passage from the surface of the earth to the said underground coal, the said third communication passage being spaced apart from the said first communication passage and the said second communication passage, the said first and second communication passages being in fluid communication with the coal fire zone, and the said third communication passage being located in the said coal outside the said coal fire zone, injecting an oxidizer into the said third communication passage, the said injecting an oxidizer being under sufficient pressure to cause at least a portion of the said oxidizer to migrate through the said coal and into the said coal fire zone, and burning an underground channel through the said underground coal from the said coal fire zone to the said third communication passage.

10. The method of claim 9 further including the steps of terminating oxidizer injection in the said third communication passage, shutting in the said second communication passage, injecting a reactant fluid into the said first communication passage, directing the products of reaction resulting from the said injecting a reactant fluid into the said coal in the said coal fire zone, into the said underground channel, pyrolyzing the said coal surrounding the said underground channel, and directing the said products of reaction together with the products of reaction resulting from the said pyrolyzing of the said coal through the said third communication passage and on to the surface of the earth.

11. The method of claim 9 further including the steps of injecting an oxidizer into the said third communication passage, shutting in the said first communication passage, withdrawing the products of reaction resulting from the said injecting an oxidizer and the said underground coal through the said second communication passage, and extending the said coal fire zone to the said third communication passage.

12. The method of claim 1 further including the step of compacting the said redistributed overburden.

13. The method of claim 1 further including the step of injecting a mud slurry into the said redistributed overburden.

14. The method of claim 1 wherein the said redistributing the overburden results in a minimum distance of 100 feet as measured from the surface of the earth to the said underground coal.

15. A method of converting an underground coal fire to useful products wherein the natural conduits from the surface of the earth to an underground coal deposit have been sealed and wherein at least a portion of the underground coal is at a temperature above the ignition point temperature of the coal, comprising the steps of:

establishing a first communication passage from the surface of the earth to the said underground coal, the said first communication passage being hermetically sealed, establishing a second communication passage from the surface of the earth to the said underground coal, the said second communication passage being spaced apart from the said first communication passage and the said second communication passage being hermetically sealed, establishing a third communication passage from the surface of the earth to the said underground coal, the said third communication passage being spaced apart from the said first communication passage and the said second communication passage, the said third communication passage being hermetically sealed, establishing a conduit through the said underground coal, the said conduit being in fluid communication with the said first communication passage and the said second communication passage, and the said conduit being in fluid communication between the said second communication passage and the said third communication passage, injecting an oxidizer into the said first communication passage, withdrawing the products of reaction through the said third communication passage, continuing injection of the said oxidizer until the coal abutting on the said conduit between the said first communication passage and the said second communication passage is incandescent, then terminating oxidizer injection, injecting steam into the said first communication passage with the resultant generation of hydrogen and carbon monoxide, injecting steam into the said second communication passage with the resultant activation of the water shift reaction wherein the ratio of hydrogen to carbon monoxide in the exit gases is greater than one to one, and withdrawing the said exit gases through the said third communication passage.

* * * * *